United States Patent [19]

Kelly

[11] 4,036,290

[45] July 19, 1977

[54] HELICAL EXPANSION CONDENSER

[76] Inventor: Donald A. Kelly, 58-06 69th Place, Maspeth, New York, N.Y. 11378

[21] Appl. No.: 219,985

[22] Filed: Jan. 24, 1972

[51] Int. Cl.[2] ..... F28B 1/06; F28D 15/00

[52] U.S. Cl. ..... 165/105; 62/3; 60/692; 165/125; 165/110; 165/133; 165/179; 165/181

[58] Field of Search ..... 165/105, 62, 163, 125, 165/110, 111, 122, 147, 179, 181, 133; 60/690–693; 62/3

[56] References Cited

U.S. PATENT DOCUMENTS

| | | | |
|---|---|---|---|
| 1,750,750 | 3/1930 | Gay | 165/105 |
| 1,791,528 | 2/1931 | Hull | 165/147 |
| 2,488,549 | 11/1949 | MacCracken | 165/147 |

FOREIGN PATENT DOCUMENTS

| | | | |
|---|---|---|---|
| 1,185,758 | 3/1970 | United Kingdom | 165/105 |

*Primary Examiner*—Albert W. Davis, Jr.

[57] ABSTRACT

The helical expansion condenser is essentially a special heat exchange unit specifically designed for closed cycle vapor turbine systems.

The helical expansion condenser, or (HEC), consists of multiple continuous turns or coils of elliptical tubing or built-up metal sheets of elliptical cross-section, which are arranged in a uniform helix.

The generally flat elliptical cross-section provides for efficient airflow and heat transfer over the entire surface area of the coils. The airflow over the HEC is provided by vehicular air intake with a large central fan forcing air over forward and aft coils uniformly. Multiple heat pipes are the primary cooling device added to the HEC coils, for a total heat transfer coefficient of 40, approximately.

Microfinning of the sheet metal ducts accounts for some of the improved cooling effectiveness.

8 Claims, 8 Drawing Figures

INVENTOR
Donald A Kelly

INVENTOR
Donald A. Kelly

HELICAL EXPANSION CONDENSER

BACKGROUND OF THE INVENTION

The present invention has been evolved by the necessity of developing an effective and generally compact heat transfer device or condensation means for the many different types of current Rankine cycle power systems.

One of the major obstacles to achieving a practical and competitive closed cycle engine or turbine system for automobiles, is that of rejecting the large amount of heat generated within the closed loop, which ranges from approximately ¾ million to 1½ million BTU per hour.

The most effective, although inefficient technique presently used is utilizing large twin fans which draw in large volumes of air over conventional twin radiators, which are used as the condensing component. This "brute force" condensing expedient can consume as much as 20% of the total rated horsepower from the expander, which is unacceptable if the closed Rankine cycle is to competitively challenge the other future alternate power systems being developed.

It is becoming most evident that the conventional type of automotive radiator, or bundle of tubing and fins must be improved upon and necessary departures made to markedly increase the condensing effectiveness.

In order to reduce airflow turbulance over the heat transfer surfaces, it is an improvement to utilize an elliptical, or symmetrical airfoil shape, instead of round tubing. The finning arrangement should remain essentially unchanged, except that it will also be necessary to "micro-fin" the sheet metal shaped ducts in the direction of the airflow.

SUMMARY OF THE INVENTION

This device relates to a helical expansion condenser (HEC) which consists of a continuous circular shaped duct which is arranged in a helical form. The hot vapor leaving the engine or auxiliary cooling turbine is piped or ducted up to the top entrance coil of the HEC, where it is directed downward, spirally through the continuous helical cooling path.

The elliptical or symmetrical airfoil cross-section of the duct varies uniformly in size/area, from the top of the HEC to the bottom, so that the incoming hot vapor undergoes a uniform pressure drop. The HEC has a minimum normal cross-section area at the top and a maximum cross-section at the bottom, in order to accelerate the condensation of the cooling vapor. The uniformly increasing cross-section area also increases the surface area exposed to the external forced air-flow from the fan, to hasten effective heat sinking.

The key feature of the HEC, without which the helical cooling path would have to be greatly increased, is the addition of uniformly spaced and canted multiple short heat pipes placed within the continuous circular shaped duct.

The application of short, cylindrical heat pipes, which are known in heat exchange art, will assure that very large amount of heat will be quickly rejected from the cooling path. Since heat pipes function by vaporizing an internally sealed working fluid, it is advantageous to apply short length heat pipes for efficiency, ease of manufacturing and replacement.

The heat pipes may be cylindrical, elliptical, or thin cross-section to suit the necessity of minimizing air flow resistance. The heat pipes may also be non-linear for matching the requirements of the shaped duct cross-section.

The combined effect of the vapor pressure decrease and constantly increasing heat transfer surface, along with heat piping means, will accelerate the condensation process, so that the condensate may be pumped back to the vapor generator, within a minimum linear length.

An important feature of the HEC concept is that the diameter of the circular helix be as large as possible in order to minimize vapor flow resistance. In a previous disclosure an expansion type condenser was proposed in a vertical zig-zag pattern with relatively sharp corner bends. It is now believed that the presently advocated circular form, helical vapor path is far more desirable and simpler to fabricate.

It is now apparent as seen from many sources, that it is most important to minimize vapor flow resistance, which in the past has accounted for the necessity of large pumping power and decreased power output for the closed systems.

Decreased vapor flow resistance is particularly necessary in high speed turbine systems, where vapor flow rates are high and the requirements for alternate heating and cooling made far more demanding, than for piston type machines.

The turbine system requires a continuous high speed vapor flow, whereas the piston type expanders have a piston travel time lag during motion reversal, which reduces the required vapor flow rate.

The various advocates and developers of closed loop Rankine cycle systems have utilized both vapor generators (boilers) and condensers which have many relatively sharp bends, and many reversals in tubing runs, which is undesirable in an otherwise efficient closed loop power system.

In essence, the disclosed helical expansion condenser (HEC) advocates minimizing vapor flow resistance, while providing rapid heat transfer through a continuous circular shaped duct arrangement in helical form.

The use of a high efficiency, centralized fan and drive means will be necessary, but the power required to drive the fan will not exceed 10% of the total rated horsepower of the expander. As an alternate supplementary cooling means, multiple cooling thermoelectric modules or thermocells would be mounted directly to the top leading edge of the lower coils of the circular duct. The arrays of cooling thermocells would provide supplementary cooling when the engine speed drops off during idling. These added thermocells may be electrically controlled by an accelerometer or other control means, so that they are energized when required.

The electrical power for the thermocells will come from several batteries mounted within the vehicle, which are recharged by an alternator driven by the turbine expander.

The multiple heat pipes are the primary added cooling device for the continuous circular ducts, and account for the sizable reduction in cooling fan power requirements.

As a further means of achieving more effective heat-sinking for the HEC, the use of "micro-finning" of the duct sheet metal surfaces will be necessary. Microfinning consists of forming or extruding a sheet metal surface with tiny, uniform V grooves, so that the surface area is increased per unit width. The metal sheets will be rolled or formed in one direction only, and when assembled, the microfins on each duct section will line up with the moving air flow.

The depth of the microfin V grooves must not exceed 0.025 for an 0.062 sheet of stock aluminum alloy. Aluminum alloy 52S appears to be most suitable for this application, although other alloys may be considered.

The additional surface area per duct section accomplished by microfinning will aid in heat dissipation, and is attractive for this application since the duct sections are relatively wide.

It should be noted that by placing the drive fan within the center of the circular duct helix, (plan view) the airflow passes over each coil section forward and aft of the central fan for optimum surface exposure to the forced air flow.

To adapt the HEC to the average automobile the maximum diameter of the duct coils must not exceed approximately 3 feet, and be no greater in height than 2½ feet, so that other units of the turbine system may be properly placed within the front compartment of the vehicle.

The hollow configuration of the HEC allows the engine or turbine to be placed within the lower portion of the duct coils, so that no useful space is lost within the engine compartment.

It is advantageous to have a large diameter flat drum type of vapor generator placed under the HEC, so that the condensate may be pumped directly into the vapor generator under a zero pressure head.

This type of HEC utilizes a continuous or series vapor path unlike one previous disclosure which indicates a combined series/parallel path to cool the vapor flow. It is now believed that an effective, continuous vapor flow is more desirable and economical than planned in some previous condenser design.

All of the objectives of the invention have been previously defined in the background description of the specifications.

Other features and details will be apparent from the following details of the design of the helical expansion condenser.

It should be understood that variations may be made in the detail design, without departing from the spirit and scope of the disclosed invention. A Disclosure Document under the title "Helical Expansion Condenser", has been filed on Jan. 13, 1972, which describes the condensing device.

REFERRING TO THE DRAWINGS

Figure 1:
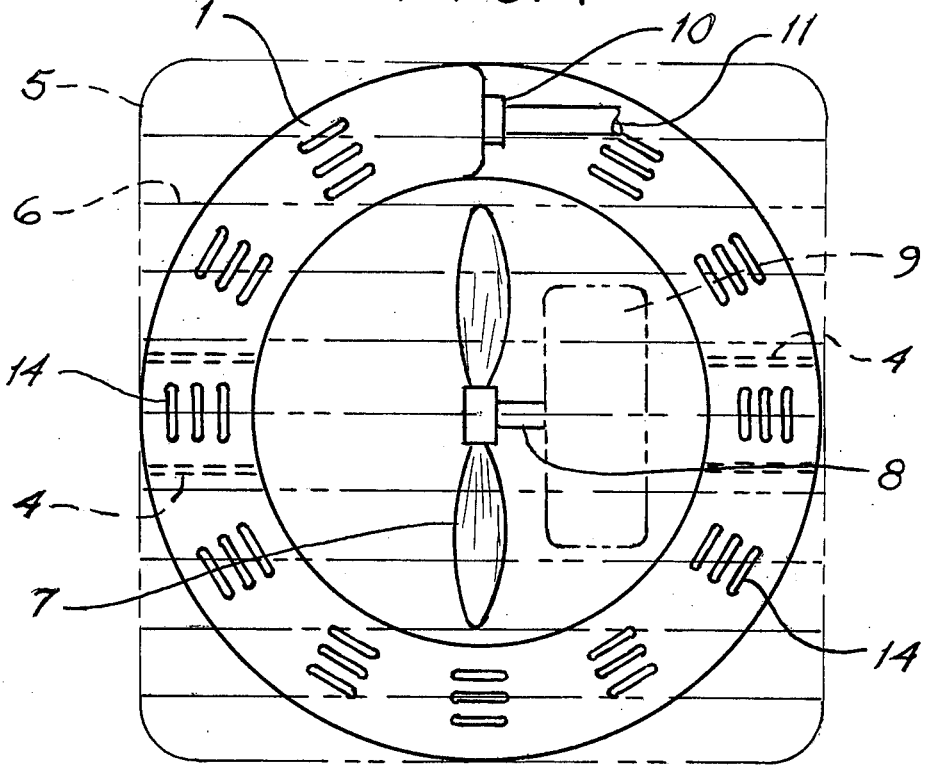
FIG. 1 is a plan view of the helical expansion condenser.
Figure 2:
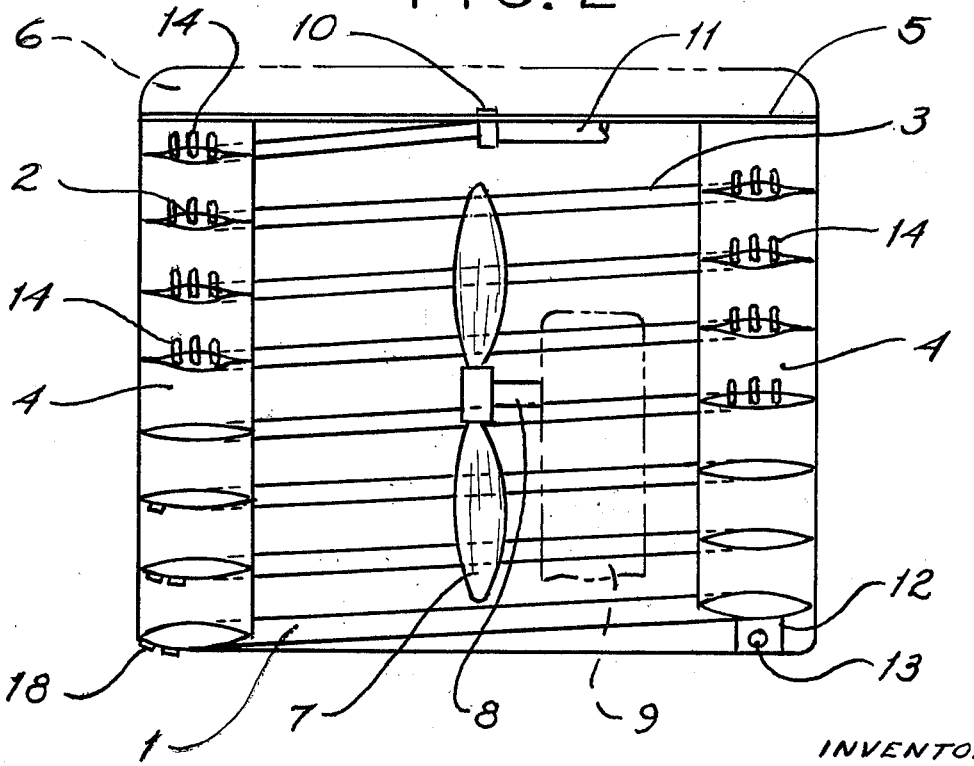
FIG. 2 is a side elevation view of the helical expansion condenser.
Figure 3:
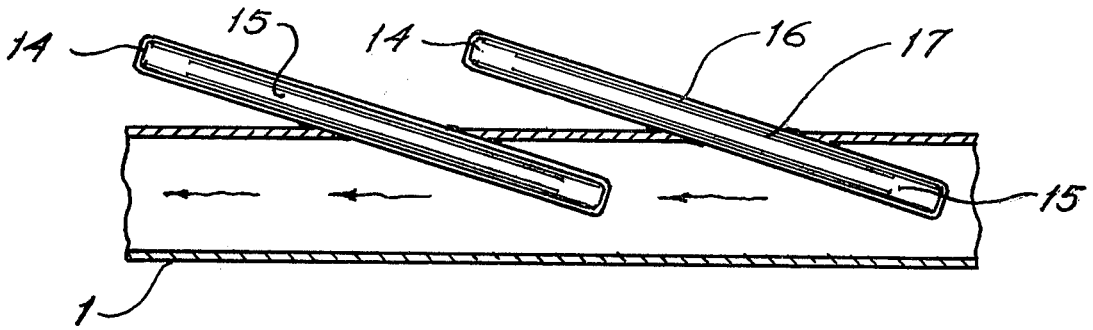
FIG. 3 is a longitudinal section view along the continuous circular shaped duct, with multiple heat pipes.
Figure 4:
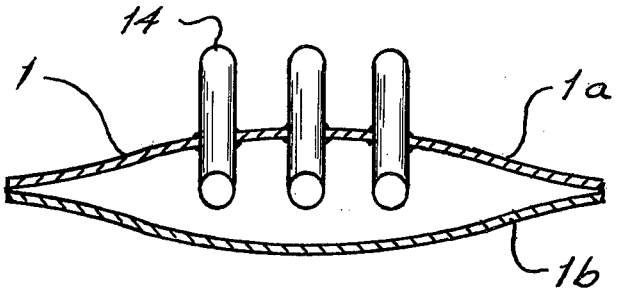
FIG. 4 is a typical duct cross-section, with multiple heat pipes.
Figure 5:
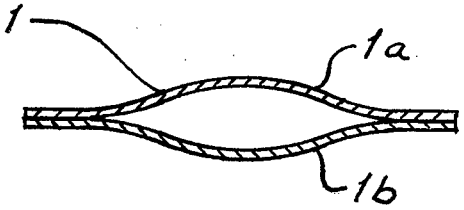
FIG. 5 is a duct cross-section at the intake top, showing minimum area.
Figure 6:
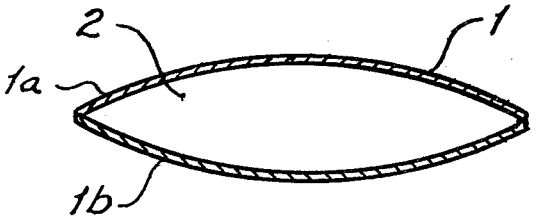
FIG. 6 is a duct cross-section at the exit bottom, showing maximum area.
Figure 7:
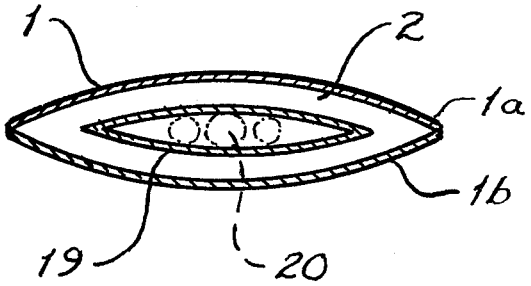
FIG. 7 is an alternate duct cross-section, showing a central small air flow duct, or tubing.
Figure 8:
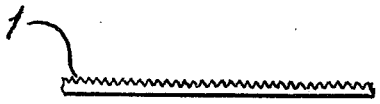
FIG. 8 is a partial section view through a duct wall showing the micro-finning configuration.

Referring to the drawings in detail, numeral 1 indicates the continuous circular shaped duct, with an elliptical or symmetrical airfoil cross-section 2, which varies from a minimum area at the top, to a maximum area at the bottom. The duct will be formed and fabricated from two identical full circle sheet metal sections, 1*a* and 1*b*. The multiple identical circular sections 1*a* and 1*b*, are lapped joined endwise to form the continuous circular helical cooling path.

The individual duct coils 3, are uniformly spaced and secured together with the linear spacer fins 4, which are placed in-line with the normal airflow.

A perforated metal sheet 5, is secured to the top of the continuous circular shaped duct 1, with multiple uniform fins 6, secured to the top of the perforated metal sheet 5, for heat dissipation and protection from the fan 7.

The fan 7, is supported by the shaft 8, which is driven by the turbine expander system 9.

The duct entrance connection 10, provides a vapor sealed coupling between the top of the duct 1, and the hot vapor inlet duct 11. A sealed condensate chamber 12, at the lower outlet end of the duct 1, collects the condensate for transfer to another point within the turbine expander system 9. A threaded port 13, within the condensate chamber 12, provides for a pipe or duct fluid transfer means.

Multiple short heat pipes 14, are uniformly placed half-way into the continuous circular shaped duct 1, for effective heat-sinking. The heat pipes 14, must be canted or angled to the duct wall, and placed in the top wall of the duct to provide gravity feed for the heat pipe working fluid 15. Screen wick 16, returns the vaporized fluid 15, to the hot end of the heat pipe 14, to repeat the transfer cycle. Insulated metallic foil 17, covers the screen wick 16. The heat pipes 14, may be made in any suitable cross-section, and be non-linear in configuration.

Multiple cooling thermoelectric modules or thermocells 18, may be added to a portion of the continuous circular shaped duct 1, as a supplementary cooling means. The cooling thermocells 18, would receive their electric power from batteries which are a part of the turbine expander system 9.

An alternate shaped duct section 2, will consist of the same duct section 2, in which an additional centralized shaped air duct section 19, or tubes 20, are provided for longitudinal airflow heat transfer.

What is claimed is:

1. A helical expansion condenser consisting of a continuous helical coil of elliptical cross-section with a vapor entrance at the top and a condensate exit at the bottom, multiple flat fin spacing means vertically disposed between the coils of said continuous helical coil, a perforated metal sheet uniformly disposed and secured to the top of said continuous helical coil, multiple uniform fins secured to the top of said perforated metal sheet, a centrally disposed cooling fan and drive means within the said continuous helical coil, sealed vapor entrance connection means disposed at the top of said continuous helical coil, sealed condensate exit means disposed at the bottom of said continuous helical coil, multiple short heat pipes angularly and uniformly disposed midway into the top surface of said continuous helical coil, weld joining and sealing of each said heat transfer pipe onto the top surface of said continuous helical coil.

2. A helical expansion condenser according to claim 1, in which said continuous helical coil of elliptical cross-section varies uniformly in cross-section area from said sealed vapor entrance at the top to said sealed condensate exit means at the bottom, a minimum cross-section area at said sealed vapor entrance at the top, a maximum cross-section area at said sealed condensate exit means at the bottom.

3. The helical expansion condenser according to claim 1, wherein said continuous helical coil of elliptical cross-section is constructed in circular sections from two identical formed metallic sheets with sealed pressure tight bonding.

4. The helical expansion condenser according to claim 1, wherein the said continuous helical coil of elliptical cross-section contains a smaller centrally disposed airflow duct.

5. The helical expansion condenser according to claim 1, wherein the said continuous helical coil of elliptical cross-section contains centrally disposed multiple airflow tubes.

6. The helical expansion condenser according to claim 1, wherein said multiple short heat pipes angularly and uniformly disposed midway into the top surface of said continuous helical coil of elliptical cross-section are circular in cross-section.

7. The helical expansion condenser according to claim 1, wherein said continuous helical coil of elliptical cross-section is uniformly microfinned in a fore and aft direction, microfinning consisting of formed tiny V grooves integrally rolled into the flat sheet metal.

8. The helical expansion condenser according to claim 1, including multiple uniformly disposed cooling thermocells secured to said continuous helical coil of elliptical cross-section the cold side of said cooling thermocells are bonded to the outside surfaces of said continuous helical coil, the hot side of said cooling thermocells are exposed to the ambient air, electric battery power means as the electrical source for said cooling thermocells.

* * * * *